United States Patent [19]

Platner

[11] Patent Number: 4,765,002

[45] Date of Patent: Aug. 23, 1988

[54] LAVATORY

[75] Inventor: Joseph W. Platner, Guilford, Conn.

[73] Assignee: American Standard Inc., New York, N.Y.

[21] Appl. No.: 477,051

[22] Filed: Mar. 21, 1983

[51] Int. Cl.[4] ..... A47K 1/04

[52] U.S. Cl. ..... 4/619

[58] Field of Search ..... 4/619, 631–635, 4/638, 650–653, 660; D23/58, 61

[56] References Cited

U.S. PATENT DOCUMENTS

| | | | |
|---|---|---|---|
| D. 28,119 | 1/1898 | Creque | 4/650 X |
| 756,239 | 4/1904 | Kelly | 4/619 |
| 1,195,684 | 8/1916 | Kelly | 4/651 |
| 1,300,268 | 4/1919 | Hinsdale | 4/651 |
| 1,468,565 | 9/1923 | Guth | 4/638 |

*Primary Examiner*—Charles E. Phillips

*Attorney, Agent, or Firm*—Robert G. Crooks; James J. Salerno, Jr.; John P. Sinnott

[57] ABSTRACT

An illustrative embodiment of the invention provides a peripheral flange generally perpendicular to the plane of the lavatory basin. The flange has a generally downwardly, inwardly sloping surface to enable the splash water to flow into the basin within the lavatory. As the flange sweeps around the periphery of the lavatory it develops into a massive spout support. The spout support enables the spout to direct water into the basin without causing the spout to extend across the basin surface. The support also has a protruding portion that establishes a reentrant basin surface in which the overflow drain is concealed from view when the lavatory is installed.

1 Claim, 2 Drawing Sheets

LAVATORY

BACKGROUND OF THE INVENTION

1. Field of the Invention

This invention relates to lavatories and more particularly, to a lavatory with a raised flange and inwardly sloping deck in which the flange undergoes a transition into a massive recessed spout support that conceals the overflow drain, and the like.

2. Prior Art

The conventional lavatory, or sink, has one or more metal spouts that extend over and above the basin. These protruding spouts deny access to a substantial portion of the lavatory basin.

Lavatory overflow drains are another unsatisfactory matter that has defied successful treatment. The gaping, often difficult to clean overflow drain almost invariably ruins what otherwise might be an attractive example of industrial design and the practical arts.

The elimination, or substantial reduction of splash water from a lavatory is another practical matter that seems to have escaped a satisfactory answer. Thus, in spite of the care with which the faucet is turned on to introduce water into the basin of the lavatory, some water almost always splashes beyond the perimeter of the lavatory. Frequently, this splash water accumulates on the counter in which the lavatory is mounted, forming pools that combine and eventually drip to the floor.

Thus, there still is an unsatisfied need in this very old and mature technology for a practical lavatory that has a concealed overflow drain that eliminates, or at least markedly reduces splashing and pooling of splash water, and prevents water faucets from monopolizing or wasting large areas of otherwise usable lavatory basin surface.

BRIEF DESCRIPTION OF THE INVENTION

These and other problems that have characterized the prior art are overcome to a large extent through one mechanical structure that embodies all of the features of the invention. Thus, in one illustrative embodiment of the invention a peripheral flange that is generally perpendicular to the plane of the basin sweeps around the perimeter of the lavatory to arrest splash water and to compel this water to pour across a sloping deck and into basin of the lavatory. The flange sweeps upward, moreover, into a massive ceramic spout support that enables water to pour directly from the spout into the basin without extending over the surface of the basin. The massive spout support, moreover, forms a protrusion in which the overflow drain is concealed in the lowermost reentrant portion below the line of sight as the lavatory is viewed in its installed position.

Thus, the invention provides a flange for a lavatory that substantially reduces splash water, supports a recessed water faucet and conceals the overflow drain to produce an overall set of results in a lavatory that heretofore has escaped satisfactory treatment in a single article of manufacture.

DETAILED DESCRIPTION OF THE PREFERRED EMBODIMENT

Figure 1:
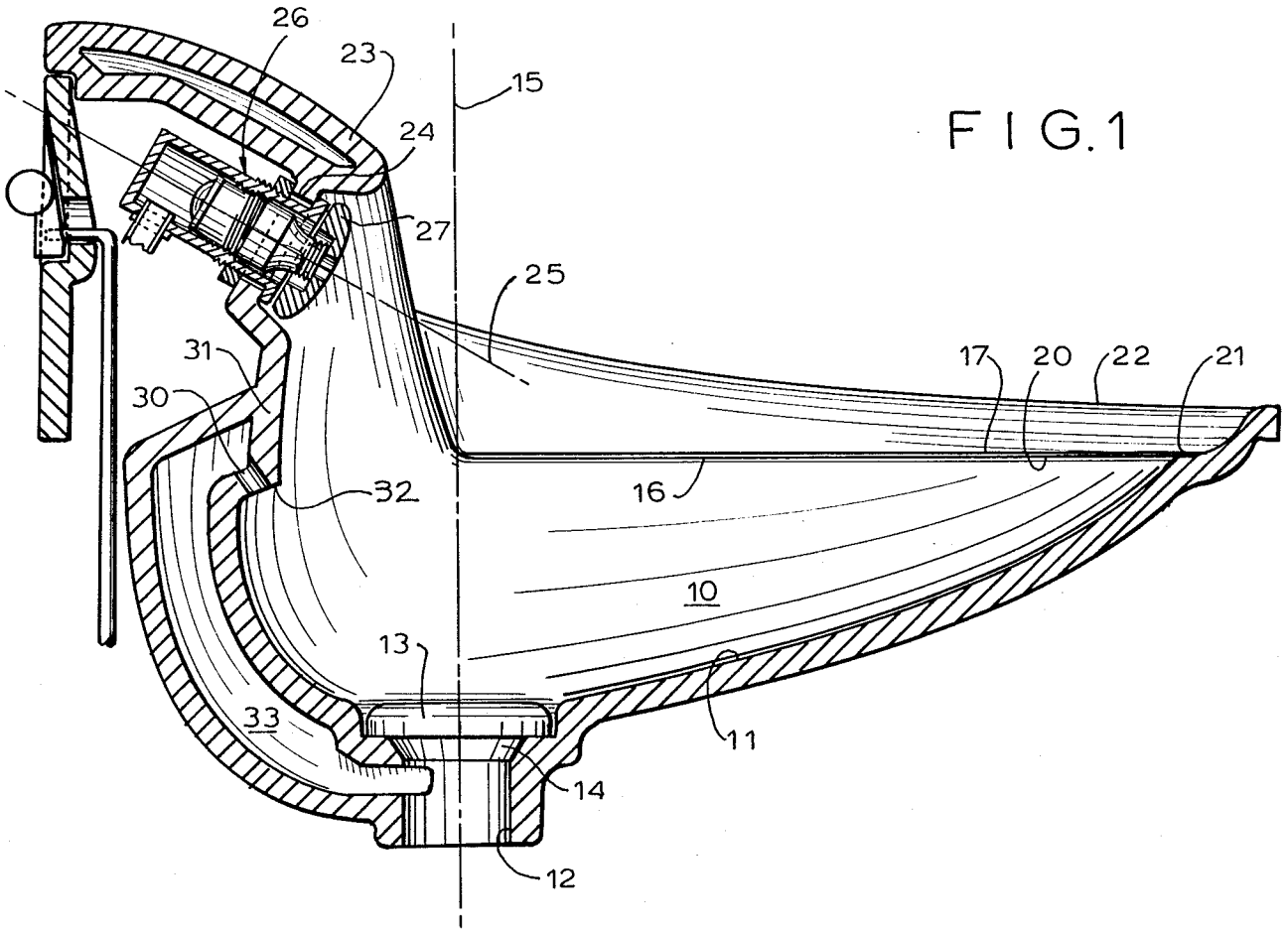
FIG. 1 is a side elevation in full section of a typical embodiment of the invention.
Figure 2:
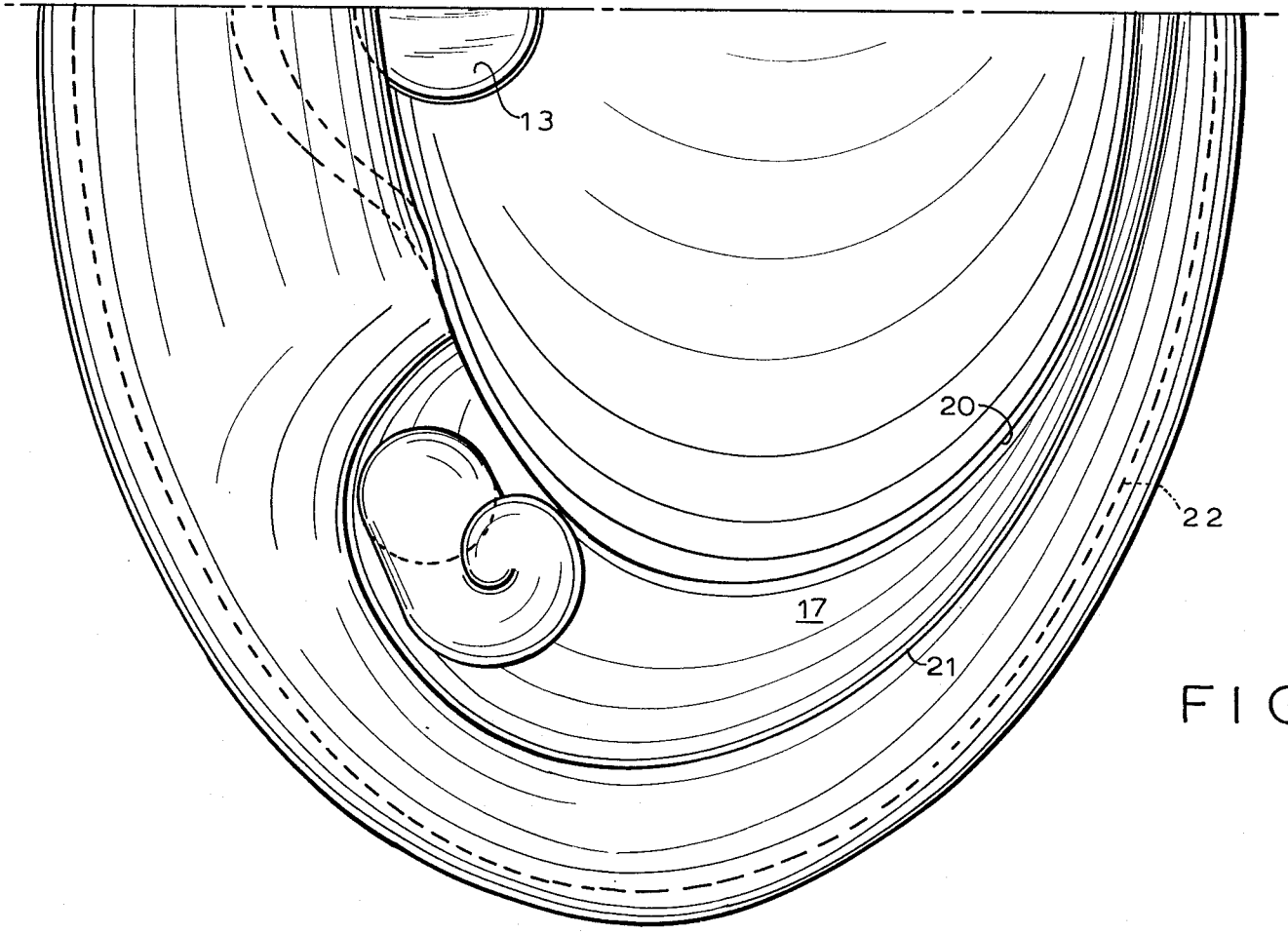
FIG. 2 is a plan view of a portion of the lavatory shown in FIG. 1.

For a more complete appreciation of the invention, attention is invited to FIG. 1 which shows a lavatory 10 that is provided with a basin 11, a drain 12 formed in the low point of the basin 11. The drain 12 is fitted with a ceramic plug 13 that is joined to a metal drain "stopper" or plug 14. The ceramic plug 13 and the drain plug 14 are generally concentric with respect to an axis 15. The basin 11 slopes from the drain 12 to form the basin 11 that terminatesin a general horizontal plane 16 which is essentially perpendicular to the axis 15. The plane 16 also defines a margin 20 of a deck 17 that slopes gently toward the basin 11. As shown in FIG. 2, the deck 17 is formed between the margin 20 and a peripheral margin 21 in a manner in which the deck 17 enjoys a continuously varying breadth in which the narrowest expanse is the most distant from the ceramic plug 13 on the minor axis of the elliptical basin 11.

In accordance with the invention, and as best shown in FIG. 1, the peripheral margin 21 of the deck 17 merges into an S-shaped curve on the basin side of a flange 22. The flange 22 extends completely around the perimeter of the lavatory 10 and the height of the flange 22 relative to the deck 17 increases gradually as the flange progresses toward the closest point of approach to the drain 12. Thus, the flange intercepts and prevents splash water from going beyond the confines of the lavatory 10.

In accordance with another feature of the invention, the flange 22, as it sweeps around the opposite sides of the drain 12 and increases gradually in height above the deck 17, merges into a massive ceramic spout support 23. The spout 23 has a centrally disposed aperture 24 that is oriented downwardly toward the basin 11 in alignment with an axis 25 that intersects the axis 15 and forms an angle of about 30° with the plane 16.

A metal spout 26 is mounted within the aperture 24. The spout 26 ends in a finished ceramic button 27 to complete the water discharge for the lavatory 10. Thus, the spout 26 is recessed within the structure of the lavatory 10 and is oriented to discharge water directly into the basin 11 without protruding any substantial portion of the spout over the plane 16 of the basin 11. In this way the flange 22 also avoids wasting usable lavatory basin area.

The massive portion of the flange 22 that houses the spout 26 also conceals the overflow drain. Consequently, attention is invited to an overflow drain 30 that is formed in the basin 11 immediately below the plane 16 in protruding 31 of the spout 23. As illustrated, the protruding portion 31 extends slightly into the basin 11 to provide a reentrant 32. The overflow drain 30 thus establishes (when necessary) fluid communication between the basin 11 and an overflow chamber 33 that is formed between the basin 11 and the spout support 23.

Thus, in accordance with the invention, an overflow drain 30 is concealed between the protruding portion 31 of the flange 22 and the reentrant surface 32 of the basin 11. In this way, the flange 22 has a varying height relative to the sloping deck 17 to provide an essentially splash free lavatory with a concealed overflow drain 30 that supports a recessed spout that does not obstruct usable basin area.

I claim:

1. A lavatory comprising, an elliptical basin having a drain that establishes an axis, a plane that is perpendicular to said axis, said plain defining the periphery of said basin, a deck extending from said basin in a direction away from said basin and said drain and forming an acute angle with said plane in order to provide a surface that slopes gently toward said basin, said deck varying continuously in breadth, the narrowest expanse of said deck being spaced furthest from said drain and at one end of the minor axis of said elliptical basin, a flange sloping away from said basin to extend higher than said deck in a gentle S-shaped curve, said flange sweeping around the lavatory to form the lavatory perimeter and increasing in height from a low point at said narrow deck expanse into a water discharge spout support that protrudes above said deck and is spaced from said drain axis in a direction away from said drain at the other end of the said minor elliptical axis wherein said basin portion immediately thereunder is reentrant with respect to said spout support to enable water to pour from said spout support into said basin without extending over the surface of the basin, and an overflow drain formed in said reentrant portion that is adjacent to said spout support and concealed thereunder.

* * * * *